US010724832B2

(12) United States Patent
Washington

(10) Patent No.: US 10,724,832 B2
(45) Date of Patent: Jul. 28, 2020

(54) THROWING GAME

(71) Applicant: Travis Washington, Philadelphia, PA (US)

(72) Inventor: Travis Washington, Philadelphia, PA (US)

( * ) Notice: Subject to any disclaimer, the term of this patent is extended or adjusted under 35 U.S.C. 154(b) by 0 days.

(21) Appl. No.: 16/525,704

(22) Filed: Jul. 30, 2019

(65) Prior Publication Data

US 2020/0158476 A1 May 21, 2020

Related U.S. Application Data

(60) Provisional application No. 62/769,653, filed on Nov. 20, 2018.

(51) Int. Cl.

| | |
|---|---|
| ***A63B 65/00*** | (2006.01) |
| ***A63B 65/04*** | (2006.01) |
| ***F41J 1/00*** | (2006.01) |
| ***F41J 3/00*** | (2006.01) |

(52) U.S. Cl.

CPC ..... *F41J 1/00* (2013.01); *A63B 65/04* (2013.01); *A63B 2209/00* (2013.01)

(58) Field of Classification Search

CPC ..... A63B 65/04; A63B 65/00; A63B 63/00; A63B 63/003; A63B 2209/00; F41J 1/00; F41J 3/00; F41J 3/0066; F41J 3/009

See application file for complete search history.

(56) References Cited

U.S. PATENT DOCUMENTS

| | | | | |
|---|---|---|---|---|
| 2,714,509 | A * | 8/1955 | Ramsey | F41B 15/00 273/408 |
| 4,940,244 | A * | 7/1990 | Batts, III | F41J 3/0004 273/403 |
| 5,294,130 | A * | 3/1994 | Woods | F41B 15/00 273/348.4 |
| 2006/0157938 | A1* | 7/2006 | Box | F41J 3/0004 273/403 |
| 2011/0169223 | A1* | 7/2011 | Reed | F41J 1/10 273/403 |
| 2018/0364014 | A1* | 12/2018 | Oliphant | F41J 1/10 |
| 2020/0038743 | A1* | 2/2020 | Chung | A63F 9/24 |
| 2020/0061485 | A1* | 2/2020 | Wendorff | A63H 33/18 |

* cited by examiner

*Primary Examiner* — Raleigh W Chiu
(74) *Attorney, Agent, or Firm* — Paul & Paul

(57) ABSTRACT

A throwing game includes a simulated axe formed from a low density material and and a target including vertically oriented strata formed from a compressible material.

9 Claims, 1 Drawing Sheet

THROWING GAME

CROSS-REFERENCE TO RELATED APPLICATION

The present application claims the priority of U.S. Provisional Patent Application 62/769,653, filed Nov. 20, 2018, which is incorporated herein by reference.

BACKGROUND OF THE INVENTION

1. Field of the Invention

The present invention relates to games in which objects are thrown towards a target.

2. Brief Description of the Prior Art

Throwing games are well known, and probably date from pre-history. In such games a game piece is physically thrown towards a target, which typically is divided into zones of decreasing area, such that accurate throws are privileged. A well-known example is the game of darts. Recently, axe throwing has become an increasingly popular recreation. Hurling a conventional axe requires substantial strength, as such axes may weigh up to a few pounds. Targets for conventional axe throwing are typically wood, such as end grain wood, that permit a well thrown axe to lodge into the target. In order to be usable, throwing axes are preferably kept as sharp as possible. New axes are sold unsharpened in order to protect employees during the manufacturing process. Sharpened axes must be handled carefully to avoid injury. Thus, conventional axe throwing can be most enjoyed by mature individuals with good upper body strength. Accordingly, there is a need for an axe throwing game which simulates conventional axe throwing, but permits individuals with lower upper body strength to enjoy the sport without the risks associated with the use of sharpened metal axes.

SUMMARY OF THE INVENTION

The present invention provides a throwing game including a simulated axe and a target. The simulated axe is preferably formed from a low density material and includes a handle and blade. The blade has a pair of major faces including an at least partially roughened surface on at least one of the pair of major faces. The target includes a plurality of vertically oriented strata. The strata is preferably formed from a compressible material. Preferably, the strata is horizontally compressed. Preferably, the force of compression is selected such that the impact of a simulated axe striking the target is sufficient to separate a pair of the strata sufficiently to embed the axe blade between the strata. Preferably, in one aspect, the roughened surface is provided by scoring the surface to roughen the surface. Preferably, the compressible material is a foamed polymeric material. Preferably, the polymeric material is a polyethylene material. Preferably, the target includes at least one clamp for compressing the strata. Preferably, the simulated axe is formed from a low density material, such as a non-metallic material. In one aspect, scores are formed generally parallel to the axe handle to provide a roughened surface. In one aspect, the total profile height ($R_t$) of the roughened surface is from about 0.4 to 4.5 mils. In another aspect, the average maximum peak to valley height (H) of the roughened surface is from about 0.8 to 4.5 mils.

DETAILED DESCRIPTION

Figure 1:
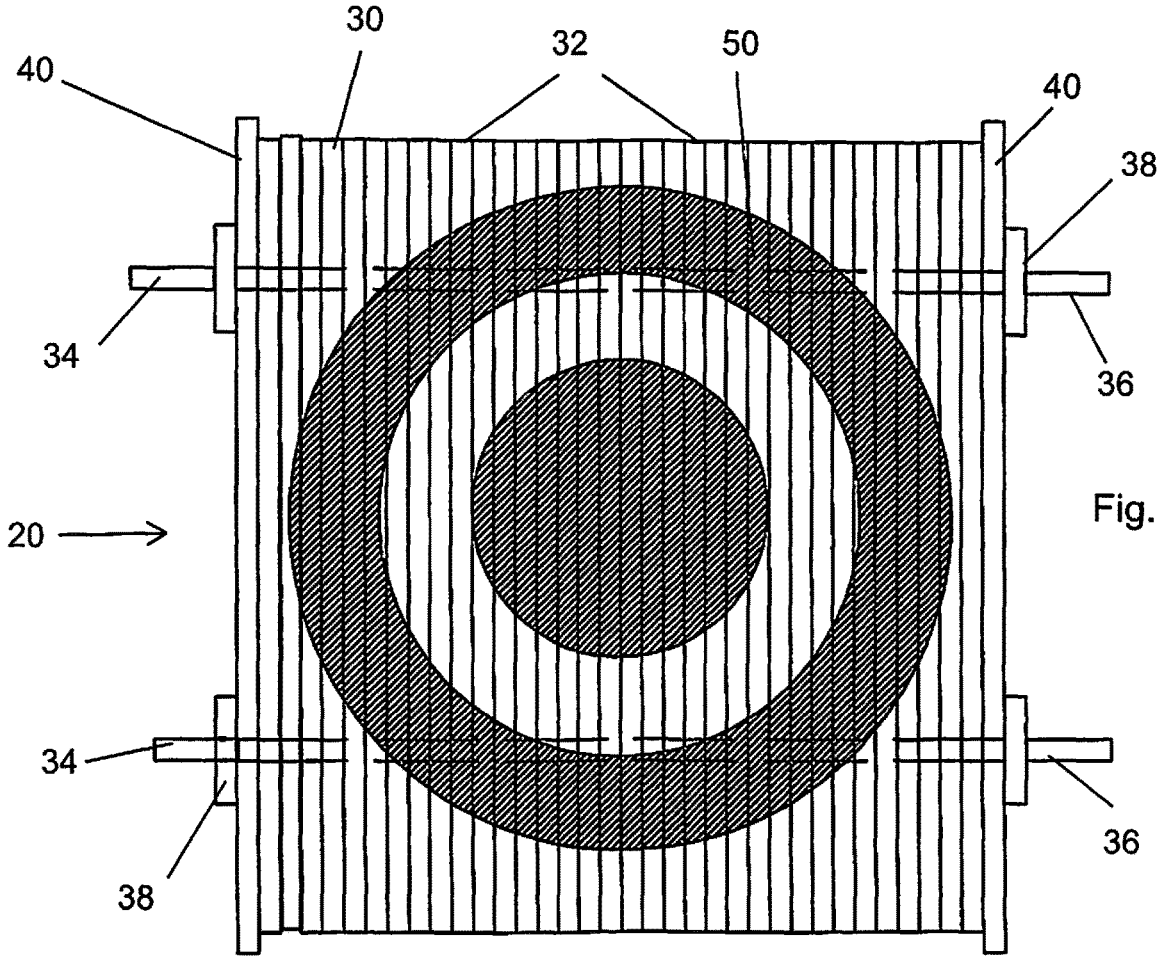
FIG. 1 is a front elevational view of a target of the throwing game of the present invention.

A target 20 for use in a throwing game according to the present invention is illustrated in the front elevational view of FIG. 1. The target 20, which is preferably about 4 feet tall, includes strata or plies 30 which are generally vertically oriented. Preferably, the strata are preferably from about 0.125 to 0.375 inches wide, and more preferably 0.25 inches wide, and preferably from about 3 to 6 inches thick, and more preferably from about 4 to 5 inches thick, asn still more preferably 5.5 inches thick. Each stratum 32 is preferably formed from a compressible material, such as a foamed plastic material, such as a polyethylene foam. The strata 30 are held between a pair of clamps 34 which serve to compress the strata 30 horizontally. The clamps 34 each include a bar 36 which is threaded at either end, and to which is affixed nuts 38. The nuts 38 bear against a pair of rigid cap members 40. The nuts 38 can be rotated to compress the strata 32 between the cap members 40. The force of compression is selected or adjusted such that the impact of a simulated axe striking the target is sufficient to separate a pair of the strata 32 sufficiently to embed the axe blade between the strata 32. Conventional target indicia 50 can be applied to the front surface of the strata 30.

Figure 2:
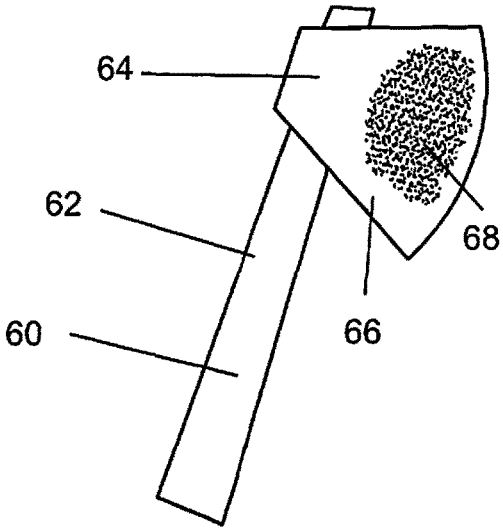
FIG. 2 is a side elevational view of a first embodiment of the simulated throwing axe of the game of the present invention.
Figure 3:
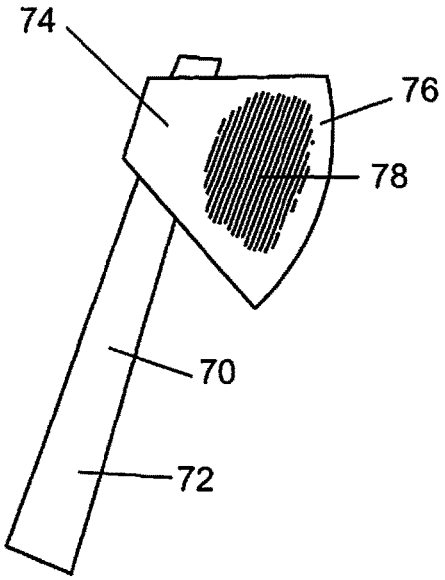
FIG. 3 is a side elevational view of a second embodiment of the simulated throwing axe of the game of the present invention.

The throwing game includes a simulated axe 60 such as shown in FIG. 2. The simulated axe 60 includes a handle 62 and a blade 64 mounted on the handle 62. Preferably, the simulated axe 60 is formed from a low density material, such as a non-metallic material such as a thermoplastic or thermosetting material. The blade 64 has a pair of major faces 66. Preferably, an at least partially roughened surface 68 is provided on at least one of the pair of major faces 66. In one aspect of the present invention, as shown in FIG. 3, the simulated axe 70 includes a handle 72 and blade 74 provided with a pair of major faces 76, with at least one of the major faces being provided with scoring 78 on the surface to roughen the surface. Preferably, the scores 78 are formed generally parallel to the axe handle 72. In one aspect of the present invention, the total profile height ($R_t$) of the roughened surface is from about 0.4 to 4.5 mils. In another aspect of the present invention the average maximum peak to valley height (H) of the roughened surface is from about 0.8 to 4.5 mils.

Various modifications can be made in the details of the various embodiments of the articles of the present invention, all within the scope and spirit of the invention as defined by the appended claims.

The invention claimed is:

1. A throwing game including:

a) a simulated axe formed from a low density material, the simulated axe including a handle and blade, the blade having a pair of major faces including an at least partially roughened surface on at least one of the pair of major faces; and b) a target including a plurality of vertically oriented strata, the strata formed from a compressible material, the strata being horizontally compressed, the force of compression being selected such that the impact of a simulated axe striking the target is sufficient to separate a pair of the strata sufficiently to embed the axe blade between the strata.

2. A throwing game according to claim 1 wherein the roughened surface is provided by scoring the surface to roughen the surface.

3. A throwing game according to claim 2 wherein the scores are formed generally parallel to the axe handle.

4. A throwing game according to claim 1 wherein the compressible material is a foamed polymeric material.

5. A throwing game according to claim 4 wherein the polymeric material is a polyethylene material.

6. A throwing game according to claim 1 further including at least one clamp for compressing the strata.

7. A throwing game according to claim 1 wherein the low density material is a non-metallic material.

8. A throwing game according to claim 1 wherein the total profile height ($R_t$) of the roughened surface is from about 0.4 to 4.5 mils.

9. A throwing game according to claim 1 wherein the average maximum peak to valley height (H) of the roughened surface is from about 0.8 to 4.5 mils.

* * * * *